US007972116B2

(12) United States Patent
Read et al.

(10) Patent No.: US 7,972,116 B2
(45) Date of Patent: Jul. 5, 2011

(54) BLADE FOR A GAS TURBINE ENGINE

(75) Inventors: Simon Read, Derby (GB); Sivasubramaniam K Sathianathan, Burton upon Trent (GB)

(73) Assignee: Rolls-Royce plc, London (GB)

( * ) Notice: Subject to any disclaimer, the term of this patent is extended or adjusted under 35 U.S.C. 154(b) by 961 days.

(21) Appl. No.: 11/826,487

(22) Filed: Jul. 16, 2007

(65) Prior Publication Data

US 2008/0019838 A1 Jan. 24, 2008

(30) Foreign Application Priority Data

Jul. 18, 2006 (GB) ..... 0614186.5

(51) Int. Cl.
*F01D 5/14* (2006.01)
*B21D 53/78* (2006.01)

(52) U.S. Cl. ..... 416/229 A; 416/241 R; 416/243; 416/248; 29/889.72

(58) Field of Classification Search ..... 29/889.72; 416/224, 229 R, 229 A, 230, 241 R, 243, 416/248

See application file for complete search history.

(56) References Cited

U.S. PATENT DOCUMENTS

| | | | | |
|---|---|---|---|---|
| 5,363,555 | A * | 11/1994 | Fowler et al. | 29/889.72 |
| 5,729,901 | A * | 3/1998 | Fowler et al. | 29/889.72 |
| 5,826,332 | A * | 10/1998 | Bichon et al. | 29/889.72 |
| 6,283,707 | B1 * | 9/2001 | Chin | 416/96 A |
| 6,418,619 | B1 * | 7/2002 | Launders | 29/889.7 |
| 7,325,307 | B2 * | 2/2008 | Franchet et al. | 29/889.72 |
| 2001/0022023 | A1 * | 9/2001 | Wallis | 29/889.72 |
| 2004/0118903 | A1 * | 6/2004 | Richardson et al. | 228/193 |
| 2004/0253115 | A1 * | 12/2004 | Williams et al. | 416/229 R |

FOREIGN PATENT DOCUMENTS

| | | |
|---|---|---|
| EP | 1 013 883 A | 1/2002 |
| GB | 0 719 079 | 11/1954 |
| GB | 2 399 866 A | 9/2004 |

* cited by examiner

*Primary Examiner* — Ninh H Nguyen
*Assistant Examiner* — Jesse Prager
(74) *Attorney, Agent, or Firm* — Jeffrey S. Melcher; Manelli Denison & Selter PLLC

(57) ABSTRACT

A blade for a gas turbine engine includes an aerofoil portion and a root portion defined by concave and convex walls having opposing inner surfaces. A reinforcing member is located between the concave and convex walls and is bonded to the inner surfaces of the concave and convex walls, and the root portion includes an unbonded region in which the reinforcing member contacts an inner surface of one of the concave and convex walls but is not bonded to the concave and convex walls.

19 Claims, 2 Drawing Sheets

BLADE FOR A GAS TURBINE ENGINE

CROSS-REFERENCE TO RELATED APPLICATIONS

This application claims priority to United Kingdom patent application No. 0614186.5, filed 18 Jul. 2006.

BACKGROUND OF THE INVENTION

Embodiments of the present invention relate to a blade, and in particular to a fan blade for a gas turbine engine.

A fan of a gas turbine engine comprises a fan rotor and a number of circumferentially spaced radially outwardly extending fan blades secured to the fan rotor. The fan is surrounded by a fan casing, which defines a fan duct, and the fan casing is arranged to contain one or more of the fan blades in the unlikely event that a fan blade becomes detached from the fan rotor.

If a fan blade becomes detached from the fan rotor, for example due to impact with a large foreign body such as a bird, the detached fan blade strikes a main fan casing containment region and generally progressively breaks up under a buckling action. Fan blades conventionally increase in strength from the tip to the root and at some position between the tip and the root the remaining portion of the fan blade, including the root, no longer buckles. The remaining portion of the fan blade has substantial mass and is accelerated by the trailing blade until it impacts a rear fan containment region of the fan casing.

It is necessary to provide additional material to the rear fan containment region of the fan casing to contain the remaining portion of a detached fan blade. The additional material may be in the form of an increase in thickness, the provision of ribs, honeycomb liners etc, the impact energy being dissipated by plastic deformation of the additional material. However, these methods of protecting the rear fan containment region are disadvantageous as they add weight to the gas turbine engine.

One approach taken to the above problem is defined in U.K. patent publication no. 2399866 (Rolls-Royce). Apertures are provided in the root which extend through that root. The apertures create beneficial deflection upon impact such that there is a reduced load placed upon the rearward portions of the fan casing. It is therefore less necessary to provide additional reinforcement in the casing to resist remaining portions of the fan blade as described above. Essentially, by allowing deformation there is a reduction in the energy transferred to the casing by encouraging break up of the root fragment about the apertures, or at least flexing as described. Unfortunately this approach requires use of intrusive machinery within the blade in order to form apertures which extend through the root generally to the blade cavity between the surfaces of that blade.

The problem with respect to machining processes such as drilling or otherwise to form the apertures is the associated risk of tool breakage in, by this stage, a relatively high value component. Furthermore, it will also be understood that break out of the aperture into the cavity formed in the blade is hard to design and control. Additionally, generally the cavity is no longer sealed by the aperture passing through the root to it and therefore generally a further operation is required in order to prevent fluid ingress to the cavity in use. Finally, it will be understood that if the cavity between the surfaces of the blade extends to a relatively low position in the root, that is to say the root is relatively thin, the introduction of apertures may create particular problems in this highly stressed region of the blade.

SUMMARY OF THE INVENTION

According to a first aspect of the present invention, there is provided a blade for a gas turbine engine, the blade including an aerofoil portion and a root portion defined by concave and convex walls having opposing inner surfaces, and a reinforcing member located between the concave and convex walls and bonded to the inner surfaces thereof, wherein the root portion includes an unbonded region in which the reinforcing member contacts an inner surface of one of the concave and convex walls but is not bonded thereto.

The reinforcing member may extend throughout the root portion between the concave and convex walls. The reinforcing member may be in the form of a reinforcing membrane.

The dimensions and/or shape and/or position of the unbonded region may be selected so that the root portion is deformable.

The root portion may include a plurality of said unbonded regions. The root portion may define first and second ends which may be located respectively adjacent to leading and trailing edges of the aerofoil portion, and the plurality of unbonded regions may be distributed throughout the root portion between the first and second ends.

The root portion may define a blade release plane and the unbonded region may extend below the blade release plane. The unbonded region may extend from the root portion towards the aerofoil portion.

The unbonded region may be generally square or may be generally rectangular.

The aerofoil portion may include a cavity which may be defined between the opposing inner surfaces of the concave and convex walls, and the unbonded region may extend to the cavity. The unbonded region may be in open passage association with the cavity.

The root portion may include a first unbonded region in which the reinforcing member contacts the inner surface of the concave wall but is not bonded thereto and may include a second unbonded region in which the reinforcing member contacts the inner surface of the convex wall but is not bonded thereto.

The first and second unbonded regions may be provided at substantially the same location on each side of the reinforcing member between the opposing inner surfaces of the concave and convex walls and the reinforcing member. Alternatively, the first and second unbonded regions may be provided at different locations on each side of the reinforcing member between the inner surfaces of the concave and convex walls and the reinforcing member.

The root portion may include a plurality of said first and second unbonded regions.

According to a second aspect of the present invention, there is provided a method for fabricating a blade for a gas turbine engine, the blade including an aerofoil portion and a root portion, the method comprising locating a reinforcing member between two wall panels and forming and bonding the wall panels to provide concave and convex walls having opposing inner surfaces with the reinforcing member bonded to the inner surfaces, wherein the method includes providing means between the inner surface of one of the concave and convex walls and the reinforcing member in the root portion to prevent bonding of the reinforcing member to the inner surface of said one wall during the bonding step and thereby form an unbonded region between the reinforcing member and said one wall.

The means may be dimensioned and/or shaped and/or positioned such that the unbonded region facilitates deformation of the root portion.

The means provided between the inner surface and the wall member may be a screen member. The screen member may comprise a silk-screen.

The screen member may be arranged to permit bonding between the inner surface of one of the concave and convex walls and the reinforcing member in predetermined bonding regions. The screen member may be provided with openings to permit said bonding in the predetermined bonding regions, and the openings may comprise a plurality of slots.

The forming step may comprise superplastically forming the wall panels and the bonding step may comprise bonding the wall panels and the reinforcing member by diffusion bonding.

The providing step may comprise providing means between the inner surfaces of both the concave and convex walls and the reinforcing member in the root portion to prevent bonding of the reinforcing member to the inner surfaces of both the concave and convex walls during the bonding step and thereby form a first unbonded region between the reinforcing member and the inner surface of the concave wall and a second unbonded region between the reinforcing member and the inner surface of the convex wall.

According to a third aspect of the present invention, there is provided a gas turbine engine including a blade according to the first aspect of the invention or a blade fabricated using the method according to the second aspect of the invention.

BRIEF DESCRIPTION OF THE DRAWINGS

Embodiments of the present invention will now be described by way of example only and with reference to the accompanying drawings, in which:—

DETAILED DESCRIPTION OF THE INVENTION

Figure 1:
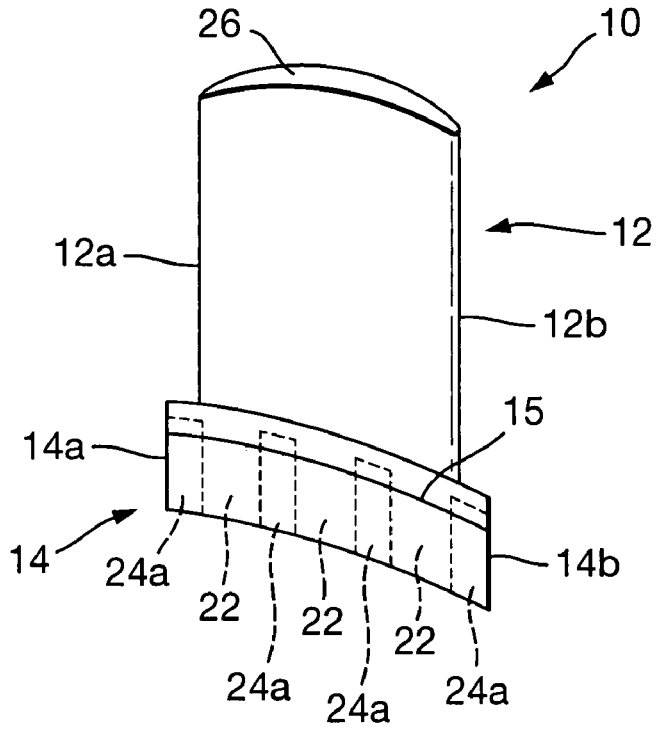
FIG. 1 is a highly diagrammatic perspective view of a blade according to the present invention.
Figure 2:
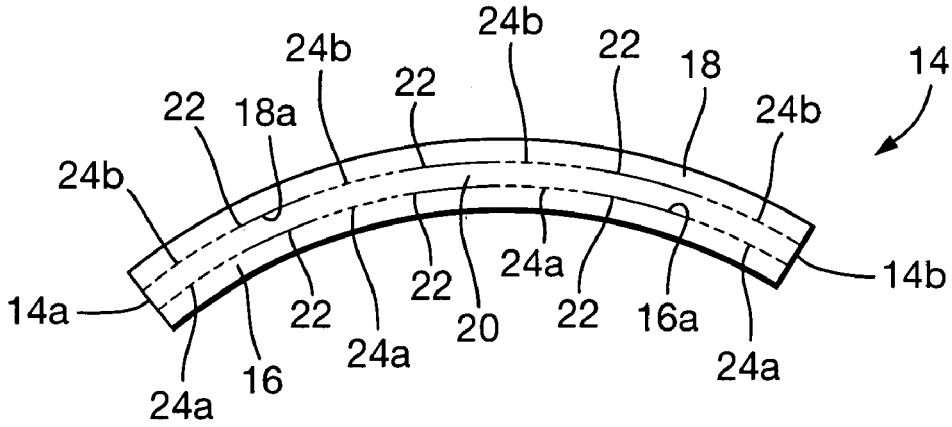
FIG. 2 is a diagrammatic cross-sectional view of a root portion of the blade of FIG. 1 along its release plane.

FIG. 1 shows a blade 10 for a gas turbine engine which includes an aerofoil portion 12 defining leading and trailing edges 12*a*, 12*b* and a root portion 14 defining a blade release plane 15. Referring also to FIG. 2 which shows a sectional view through the root portion 14 along the blade release plane 15, it can be seen that the root portion 14 is defined by concave and convex walls 16, 18.

A reinforcing member 20 in the form of a reinforcing membrane extends throughout the aerofoil portion 12 and the root portion 14 between the concave and convex walls 16, 18. The reinforcing member 20 is bonded to the inner surfaces 16*a*, 18*a* of the concave and convex walls 16, 18 in predetermined bonding regions 22 (shown diagrammatically in FIG. 2 as solid lines). The root portion 14 also includes a plurality of first and second unbonded regions 24*a*, 24*b* (shown diagrammatically as broken lines in FIGS. 1 and 2) in which the reinforcing member 20 contacts the inner surfaces 16*a*, 18*a* of the adjacent concave and convex walls 16, 18 but is not bonded to the inner surfaces 16*a*, 18*a*. As will be explained in more detail later in the specification, the first and second unbonded regions 24*a*, 24*b* facilitate deformation of the root portion 14 upon impact with a fan containment region of a gas turbine engine fan casing.

As can be seen in FIGS. 1 and 2, the root portion 14 generally defines first and second ends 14*a*, 14*b* which are located respectively adjacent to the leading and trailing edges 12*a*, 12*b* of the aerofoil portion 12. In order to maximise the deformability of the root portion 14 upon impact with a fan casing, the plurality of first and second unbonded regions 24*a*, 24*b* are distributed throughout the root portion 14, between the first and second ends 14*a*, 14*b*. In embodiments of the invention, the plurality of first and second unbonded regions 24*a*, 24*b* are spaced equally between the first and second ends 14*a*, 14*b*.

In the embodiment of FIG. 2, the plurality of first and second unbonded regions 24*a*, 24*b* are provided at substantially the same location on each side of the reinforcing member 20 between the reinforcing member 20 and the inner surface 16*a*, 18*a* of the adjacent concave or convex wall 16, 18.

Although four generally rectangular first and second unbonded regions 24*a*, 24*b* are shown in FIGS. 1 and 2, it should be appreciated that any number of first and second unbonded regions 24*a*, 24*b* may be provided to achieve the desired deformability of the root portion 14. Moreover the dimensions and/or shape and/or position of the first and second unbonded regions 24*a*, 24*b* can be selected to provide the required deformability.

The first and second unbonded regions 24*a*, 24*b* extend in a radially inwards direction below the blade release plane 15 and in a radially outwards direction from the root portion 14 towards the aerofoil portion 12 of the blade 10 towards a cavity 26 defined between the concave and convex walls 16, 18. In embodiments of the invention, the unbonded regions 24 can extend into open passage association with the cavity 26 although it is preferred that the unbonded regions 14 stop short of the cavity 26 so that the cavity 26 remains sealed.

Figure 3:
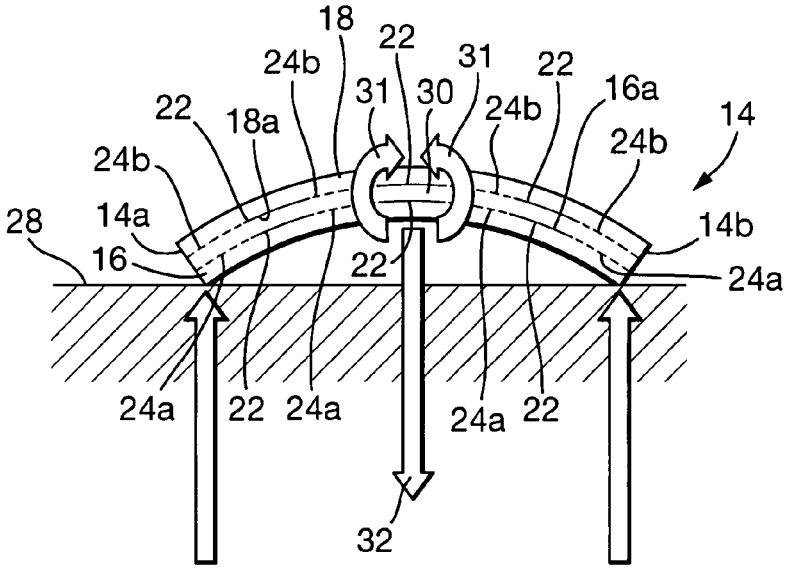
FIG. 3 is a diagrammatic illustration of the root portion of FIG. 2 impacting a fan casing of a gas turbine engine.

FIG. 3 illustrates the impact regime of the root portion 14 with the fan containment region of a gas turbine engine fan casing 28 after fracture of the blade 10. As can be seen in FIG. 3, due to the curved shape of the concave and convex walls 16, 18, it is the first and second ends 14*a*, 14*b* of the root portion 14 that initially impact the fan casing 28. By providing one or more first and/or second unbonded regions 24*a*, 24*b*, bending and hinging of the root portion 14 about the central region 30, as shown by arrows 31, is facilitated. This allows the root portion 14 to more readily flex and deform, thereby dissipating energy and reducing the impact forces. In particular, the bending causes flexing of the root portion 14 towards the fan casing 28. This causes the central region 30 of the root portion 14, between the first and second ends 14*a*, 14*b*, to move in the direction of arrow 32 towards the fan casing 28. The impact surface area between the root portion 14 and the fan casing 28 is thereby increased, providing said dissipation of energy and reduction of the impact forces.

The provision of first and/or second unbonded regions 24*a*, 24*b* may also promote further fragmentation of the root portion 14 through cracking about the unbonded regions 24*a*, 24*b*.

A method for fabricating the blade 10 shown in FIGS. 1 to 3 will now be described with reference to FIG. 4 in which there is shown an arrangement of panels 40 used to fabricate the blade 10. The arrangement 40 comprises a first wall panel 42, or pressure panel, which provides the concave wall 16 of the formed blade 10, and a second wall panel 44, or suction panel, which provides the convex wall 18 of the formed blade 10. The arrangement 40 also includes a reinforcing membrane 46 and two screen members 48*a*, 48*b*.

In order to fabricate the blade 10, the first and second wall panels 42, 44 are arranged to sandwich the reinforcing membrane 46 between them. The screen member 48*a* is also located between the first wall panel 42 and one side of the reinforcing membrane 46 and the screen member 48*b* is located between the second wall panel 44 and an opposite side of the reinforcing membrane 46.

Figure 4:
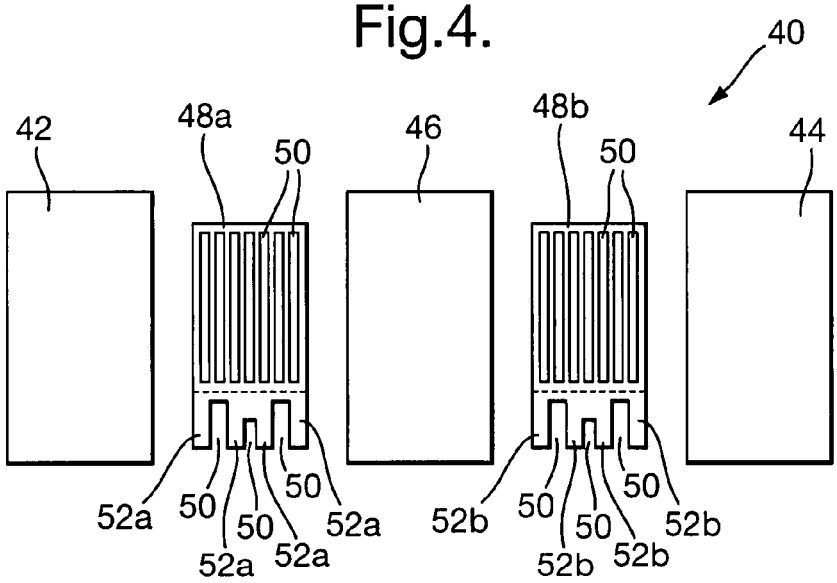
FIG. 4 is a schematic illustration of a plurality of panels which are utilised to form a blade according to the present invention.

As can be seen in FIG. 4, each of the screen members 48*a*, 48*b* includes a plurality of openings 50 which may be in the form of slots. Where these are provided, bonding can occur between the first and second wall panels 42, 44 and the adjacent surface of the reinforcing membrane 46. However, where the openings 50 are not provided, the screen member 48*a*, 48*b*, which is conventionally a silk-screen, prevents bonding between the first and second wall panels 42, 44 and the adjacent surface of the reinforcing membrane 46. Thus, in the screen members 48*a*, 48*b* shown in FIG. 4, it is the four downwardly depending leg portions 52*a*, 52*b* that result in the formation of the four first and second unbonded regions 24*a*, 24*b* in the root portion 14 of the blade 10.

The blade 10 is formed by diffusion bonding and super plastic forming processes which are themselves known in the art.

In the diffusion bonding process, the peripheral edges of the first and second wall panels 42, 44 are secured together by diffusion bonding. Each of the first and second wall panels 42, 44 are also secured to the reinforcing membrane 46 by diffusion bonding in regions where there are openings 50 in the screen members 48*a*, 48*b*. In regions where openings 50 in the screen members 50 are not present, diffusion bonding of the first and second wall panels 42, 44 to the reinforcing membrane 46 is prevented.

In the super plastic forming process, the first and second wall panels 42, 44 are deformed to provide the concave and convex walls 16, 18 of the blade 10. The super plastic forming process also provides the cavity 26 as a result of outward expansion of the first and second wall panels 42, 44. Due to the fact that the reinforcing membrane 46 is bonded to the first and second wall members 42, 44 in predetermined bonding regions, which are determined by the location of the openings 50, the super plastic forming process also deforms the reinforcing membrane 46 so that it extends across the cavity 26 to provide a so called line core reinforcement structure.

To complete the diffusion bonding and super plastic forming process, a suitable chemical is introduced into the blade 10 to remove the screen members 48*a*, 48*b* by dissolving them.

Although embodiments of the invention have been described in the preceding paragraphs with reference to various examples, it should be appreciated that various modifications to the examples given may be made without departing from the scope of the present invention, as claimed.

For example, one or more of the first unbonded regions 24*a* may be provided between the reinforcing member 20 and the inner surface 16*a* of the concave wall 16 without any of the second unbonded regions 24*b* being provided such that the reinforcing member 20 is bonded to the inner surface 18*a* of the convex wall 18 over its entire inner surface 18*a*. Alternatively, one or more of the second unbonded regions 24*b* may be provided between the reinforcing member 20 and the inner surface 18*a* of the convex wall 18 without any of the first unbonded regions 24*a* being provided such that the reinforcing member 20 is bonded to the inner surface 16*a* of the concave wall 16 over its entire inner surface 16*a*.

The plurality of first and second unbonded regions 24*a*, 24*b* may be provided at different positions on each side of the reinforcing member 20 between the reinforcing member 20 and the inner surface 16*a*, 18*a* of the adjacent concave or convex wall 16, 18.

We claim:

1. A blade for a gas turbine engine, the blade comprising:

an aerofoil portion having a sealed cavity;

a root portion defined by concave and convex walls having opposing inner surfaces, the aerofoil portion connected to the root portion; and a reinforcing member located between the concave and convex walls and bonded to the inner surfaces thereof, wherein the root portion includes unbonded regions in which the reinforcing member contacts an inner surface of one of the concave and convex walls but is not bonded thereto, the unbonded regions stopping short of the cavity so that the cavity remains sealed, wherein the dimensions, shape and position of the unbonded regions is selected so that the root portion is deformable.

2. A blade according to claim 1, wherein the reinforcing member extends throughout the root portion between the concave and convex walls.

3. A blade according to claim 1, wherein the root portion includes a plurality of said unbonded regions.

4. A blade according to claim 3, wherein the root portion defines first and second ends respectively adjacent to leading and trailing edges of the aerofoil portion, the plurality of unbonded regions being distributed throughout the root portion between the first and second ends.

5. A blade according to claim 1, wherein the root portion defines a blade release plane and the unbonded regions extend below the blade release plane.

6. A blade according to claim 1, wherein the unbonded regions extend from the root portion towards the aerofoil portion.

7. A blade according to claim 1, wherein the root portion includes a first unbonded region in which the reinforcing member contacts the inner surface of the concave wall but is not bonded thereto and a second unbonded region in which the reinforcing member contacts the inner surface of the convex wall but is not bonded thereto.

8. A blade according to claim 7, wherein the first and second unbonded regions are provided at substantially the same location on each side of the reinforcing member between the opposing inner surfaces of the concave and convex walls and the reinforcing member.

9. A blade according to claim 7, wherein the root portion includes a plurality of said first and second unbonded regions.

10. A method for fabricating a blade for a gas turbine engine, the blade including an aerofoil portion defining a cavity and a root portion, the method comprising:

locating a reinforcing member between two wall panels of the root portion and forming and bonding the wall panels to provide concave and convex walls having opposing inner surfaces with the reinforcing member bonded to the inner surfaces; and providing means between the inner surface of one of the concave and convex walls and the reinforcing member in the root portion to prevent bonding of the reinforcing member to the inner surface of said one wall during the bonding step and thereby form unbonded regions between the reinforcing member and said one wall, the unbonded regions stopping short of the cavity so that the cavity remains sealed, wherein the dimensions, shape and position of the unbonded regions is selected so that the root portion is deformable.

11. A method according to claim 10, wherein the means provided between the inner surface and the wall member is a screen member.

12. A method according to claim 11, wherein the screen member is arranged to permit bonding between the inner surface of one of the concave and convex walls and the reinforcing member in predetermined bonding regions.

13. A method according to claim 12, wherein the screen member is provided with openings to permit said bonding in the predetermined bonding regions.

14. A method according to claim 13, wherein the openings comprise a plurality of slots.

15. A method according to claim 10, wherein the forming step comprises superplastically forming the wall panels.

16. A method according to claim 10, wherein the bonding step comprises bonding the wall panels and the reinforcing member by diffusion bonding.

17. A method according to claim 10, wherein the providing step comprises providing means between the inner surfaces of both the concave and convex walls and the reinforcing member in the root portion to prevent bonding of the reinforcing member to the inner surfaces of both the concave and convex walls during the bonding step and thereby form a first unbonded region between the reinforcing member and the inner surface of the concave wall and a second unbonded region between the reinforcing member and the inner surface of the convex wall.

18. A gas turbine engine including a blade as defined in claim 1.

19. A gas turbine engine including a blade fabricated using the method defined in claim 10.

* * * * *